United States Patent [19]

Block

[11] 4,034,434

[45] July 12, 1977

[54] SWEEPER DUST SEAL

[75] Inventor: Thomas S. Block, Muskegon, Mich.

[73] Assignee: Clarke-Gravely Corporation, Muskegon, Mich.

[21] Appl. No.: 655,059

[22] Filed: Feb. 4, 1976

[51] Int. Cl.[2] ..... E01H 1/04

[52] U.S. Cl. ..... 15/79 R

[58] Field of Search ..... 15/79 R, 79 A, 83, 84, 15/85, 86, 340

[56] References Cited

U.S. PATENT DOCUMENTS

| | | | |
|---|---|---|---|
| 2,689,367 | 9/1954 | Parker | 15/79 |
| 2,749,564 | 6/1956 | Tally | 15/79 |
| 3,201,819 | 8/1965 | Wilgus | 15/79 X |
| 3,513,498 | 5/1970 | Bennich | 15/84 |

*Primary Examiner*—Edward L. Roberts

*Attorney, Agent, or Firm*—Price, Heneveld, Huizenga & Cooper

[57] ABSTRACT

This specification discloses a roller-type dust seal for use in a sweeper of a type including a dust receiver or bin having an open end spaced from a brush and from the surface being swept. A generally U-shaped axle having an elongated base is positioned transversely of the brush and supported adjacent the inlet opening of the dust receiver. The legs of the axle are secured to the bin so that the base portion is generally free floating. A plurality of generally hollow, cylindrically shaped, abutting roller segments are received on the axle. The roller segments have a relatively hard inner peripheral surface and a relatively soft outer peripheral surface.

5 Claims, 3 Drawing Figures

SWEEPER DUST SEAL

BACKGROUND OF THE INVENTION

This invention relates to sweepers of either the manual or self-propelled type and more particularly to a unique roller-type dust seal positionable adjacent the inlet of a sweeper dust bin.

Industrial sweepers, whether of the push or the self-propelled type, are well known and are employed for cleaning shop areas, sidewalks and the like. These sweepers generally include some form of brush housing within which is mounted a rotatable, cylindrical-type brush. A dust receiving bin which is open at one end is mounted in a generally horizontal position, spaced slightly upward from the surface to be cleaned and adjacent the brush. Debris contacted by the rotating brush is swept upwardly and deposited into the bin.

Some form of seal arrangement must be positioned at the pickup junction or the area adjacent the lower, transversely extending lip of the bin. A depending flap secured to the lower lip and extending downwardly to the surface to be swept has been employed to prevent debris from being propelled through the open area between the brush and the bin. When fairly large debris is encountered, the flap has a tendency either to raise along a substantially large portion of its length, or merely push the debris forwardly thereby resulting in an ineffective seal.

In an attempt to alleviate these sealing problems, various forms of roller-type seals have been proposed. For example, U.S. Pat. No. 2,689,367 to Parker, entitled SWEEPER and issued on Sept. 21, 1954, discloses a push sweeper arrangement incorporating a fixedly positioned axle extending transversely along the lower lip of a dust receiving bin. Positioned on the axle are a plurality of generally hollow, cylindrical roller segments formed of a rubber material. Due to the manner of attachment of the axle to the dust receiver, a fairly elaborate mechanism must be incorporated to provide for vertical adjustment of the open end of the bin to insure proper contact of the rollers with the surface being cleaned.

Another example of a roller-type dust seal may be found in U.S. Pat. No. 3,201,819 to Wilgus, entitled SWEEPER and issued on Oct. 24, 1965. This patent discloses a self-propelled sweeper incorporating a vertically movable sub-frame and a pair of spaced, generally parallel axles extending between side plates of the sub-frame. The ends of the axles are received within vertically extending slots in the side plates and a plurality of generally hollow rollers are positioned on each axle. This arrangement, while permitting vertical movement of the rollers and the axle with respect to the side frame, is a fairly complex and bulky structure not readily adaptable to the wide variety of sweepers which are presently available.

A need exists, therefore, for a relatively simple roller-type dust seal which is readily adaptable to the wide variety of presently available sweepers and which automatically adjusts to depressions in the surface being swept and readily raises to permit passage of large articles encountered during the sweeping process.

SUMMARY OF THE INVENTION

In accordance with the present invention, a unique roller-type dust seal is provided whereby the problems heretofore experienced are substantially alleviated and whereby the efficiency of a conventional sweeper is substantially increased. Essentially, the roller-type seal includes a generally U-shaped axle having an elongated base portion. A plurality of generally hollow, cylindrically shaped roller segments are positioned on the axle concentric with the elongated base. The legs of a U-shaped axle are secured to the lower lip of a dust receiving bin so that the elongated base is essentially free floating. This arrangement, therefore, permits independent vertical movement of the rollers and of the elongated base of the axle. Further, the U-shaped axle, when secured to the lower lip of the bin, is angled from the horizontal so that the rollers are allowed to dip down into floor depressions during use.

DETAILED DESCRIPTION OF THE PREFERRED EMBODIMENT

Figure 1:
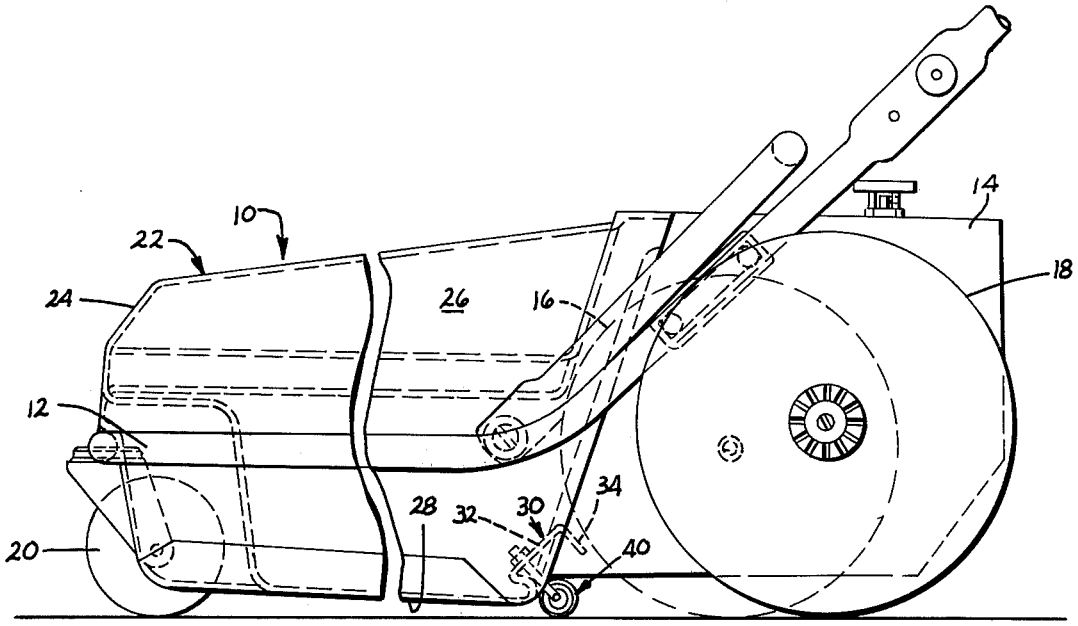
FIG. 1 is a side, elevational view of a typical sweeper incorporating the roller-type dust seal in accordance with the present invention.

A typical sweeper for which the roller seal in accordance with the present invention is readily adaptable is illustrated in FIG. 1 and generally designated 10. Sweeper 10 is of the push variety and includes a tubular frame 12, a brush housing 14, a cylindrical rotary brush assembly schematically shown and designated 16 and ground engaging wheels 18. A forwardly mounted caster wheel 20 supports the forward end of the sweeper. A dust receiving bin 22 is supported at its forward, closed end by the frame 12 and at its rearwardly facing open end by the brush housing 14.

The dust bin 22 includes a front wall 24, side walls 26 and a bottom wall 28. Th bottom wall 28 terminates adjacent the inlet opening of the bin in a generally inverted V-shaped lip portion 30. The lip portion 30 includes an upwardly angled debris retaining or dam portion 32. A downwardly angled portion 34 directs debris swept by the brush 16 upwardly and over the lip 30 into the bin 22. A more detailed description of the push sweeper generally illustrated in FIG. 1 may be found in co-pending, commonly owned application Ser. No. 655,060, entitled SWEEPER, filed on even date herewith by the present inventor.

Figure 2:
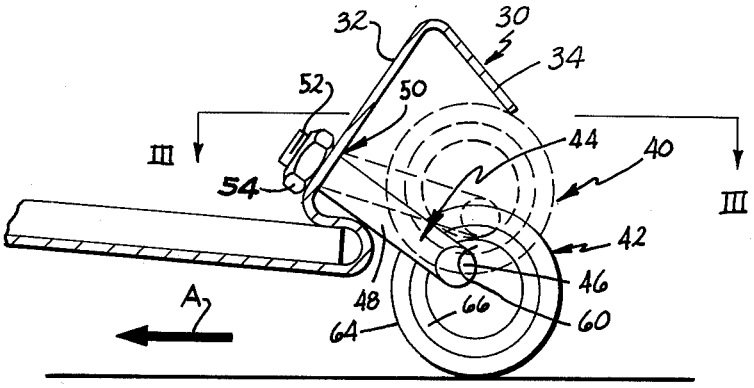
FIG. 2 is a fragmentary, enlarged, cross-sectional side elevational view showing the manner of attachment of the split roller seal to the lower lip of a dust receiving bin.
Figure 3:
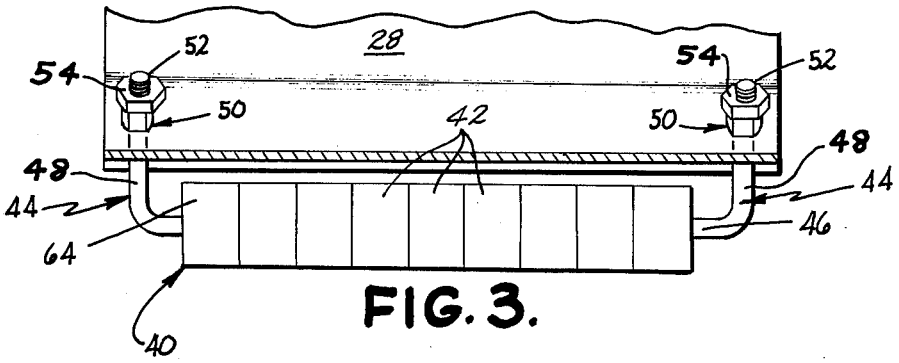
FIG. 3 is a fragmentary, cross-sectional view taken generally along line III—III of FIG. 2.

A roller seal in accordance with the present invention and generally designated 40 is best seen in FIGS. 2 and 3. The roller seal 40 includes a plurality of hollow, generally cylindrical roller segments 42 rotatably supported in an abutting relationship on a transversely extending axle 44. The axle 44 is generally U-shaped and includes an elongated base portion 46 and leg portions 48. The leg portions 48 are received within spaced apertures 50 formed in the upwardly angled portion 32 of the lip 30. The free ends of the legs 48 may be threaded as at 52 and internally threaded fasteners or nuts 54 may be secured to the legs 48 after they have been passed through the apertures 50. These nuts 54 or other suitable retaining means secure the axle 44 to the lip portion 30 of the dust bin 22. The apertures 50, as illustrated, in FIG. 3 are larger than the axle legs 48. The oversided apertures in effect make the axle assembly 44 free floating. As a result, the entire axle assembly may pivot upwardly about the apertures 50 so that the elongated base 46 moves in a generally vertical direction. This is indicated in phantom in FIG. 2. The purpose of this free floating axle arrangement will be more fully described below.

As shown, each roller segment 42 has an internal diameter which is substantially greater than the diameter of the elongated base portion 46 of the axle 44. As a result, when debris is encountered during sweeping, each roller segment may independently move in a vertical direction to permit passage of the debris to the sweeper brush. Also, the roller segments are dimensioned so that when the sweeper is pushed in the direction of the arrow A the elongated base portion 46 will contact the inner peripheral surface of the roller segments along the upper left-hand quadrant of the roller when viewed as in FIG. 2. Since the legs 48 are angled downwardly from the horizontal a pulling force is naturally exerted on the rollers in this area. As a result, a space 60 exists between the elongated base 46 of the axle and the vertical centerline of each roller segment 42. In use, should irregularities be encountered in the surface being swept, the roller segments 42 may slide downwardly on the axle 44 and thereby dip down into any depressions. The internal diamater of the roller segments 42 is selected so that this automatic self-adjusting feature is present in the seal. The dimensions of each roller will, of course, vary with the height of the bin inlet above the ground and with the length of depending lip portion 34. To be effective, the rollers must block passage of debris forwardly of the brush.

Preferably, the roller segments each possess a relatively hard, friction reducing surface at their inner peripheries and a relatively soft surface at their outer peripheries to increase the efficiency of the sweeper seal. This is accomplished by dividing the thickness of each roller segment into two portions including a soft outer portion 64 and a hard, inner portion 66. In effect, the roller segments 42 are made up of concentric, interfitting generally cylindrical portions. The hard inner surface reduces the frictional contact between the base 46 of the axle and the rollers. Since the outer surface of each roller segment is of a softer composition, the frictional contact between each roller segment and the surface to be cleaned is increased.

This two portion structure, therefore, increases the rolling action of each segment and also increases the pickup capabilities of the sweeper. Each roller segment acts to direct debris such as paper and the like generally upwardly and into the brush. As debris is encountered, each roller may move radially or vertically of the base 46. If an especially large piece of debris is encountered, the rollers will move upwardly and the base portion 46 will also move upwardly thereby permitting passage of the debris into the rotating brush structure.

The soft outer surface of each roller insures rolling action when polished floors are swept. Since sliding of the rollers is prevented, debris will not be merely pushed forwardly by the seal. Rather, the rollers will pass over the debris which will then be contacted by the brush.

A roller having the inner core 66 formed from a rigid vinyl material having a Shore D Durometer of 65/75 and an outer core 64 formed from a softer vinyl material having a Shore A Durometer of 40/50 has been found to possess the desired characteristics. The two core roller may be easily formed as an integral piece through conventional dual extrusion processes.

Although the structure has been illustrated as employing oversized apertures formed in an upwardly directed lip portion of a dust bin to accomplish the free floating of the axle structure, the ends of the legs 48 could be rigidly secured to a dust bin and the axle could be formed from a somewhat resilient material such as spring steel. Such an arrangement would permit upward flexing of the elongated base 46 about the connection points of the legs 48 to the dust bin. Also, if the dust seal in accordance with the present invention is incorporated in a sweeper structure which does not include an upwardly directed lip portion in the dust bin, separate brackets could be secured to the side walls of the dust bin so as to receive the legs 48 thereby mounting the seal to the dust bin.

In a typical arrangement, each roller would have a longitudinal dimension of approximately 1¼ inches, an outer diameter of 2½ inches and an inner diameter of 1½ inches. The thickness of the roller would be divided approximately equally into the hard inner core and the soft outer core.

The present invention therefore provides a simple roller-type seal arrangement which permits radial movement of the rollers relative to an axle structure and vertical movement of the axle structure relative to the sweeper or the dust bin. Also, the structural arrangement of the seal is such that the rollers readily adjust to depression type irregularities in the surface being cleaned without the necessity of separate adjusting mechanisms. An effective seal is provided which retains the dust, paper and other debris within the confines of the pickup junction of the sweeper so that the rotating brush will sweep the material forwardly and into the dust bin.

The embodiments of the invention in which an exclusive property or privilege is claimed are defined as follows:

1. A roller-type dust seal for use with a sweeper having a generally horizontally positioned, open ended dust bin, said seal comprising:

an axle having an elongated base positioned adjacent the inlet of the dust bin;

means for attaching said axle to said dust bin and for permitting movement of said elongated base in a generally vertical direction; and a plurality of roller segments concentric with said elongated base, said roller segments each having a generally hollow, cylindrical shape and an inner diameter greater than the diameter of said elongated base, said rollers further having a relatively hard inner peripheral surface and a relatively soft outer peripheral surface whereby said roller segments are free to move radially of said axle and said elongated base of said axle is free floating and may also move in a vertical direction, said axle being generally U-shaped having legs extending generally perpendicular from the ends of said elongated base, said base and said legs being in substantially the same plane, the plane of said axle being positioned at an acute angle from the horizontal plane of said dust bin and said elongated base trailing said dust bin in the direction of travel of said sweeper.

2. A roller-type dust seal as defined by claim 1 wherein each of said roller segments has an internal dimension and said legs have a length dimension such that said elongated base contacts the upper inner peripheral quadrant of said roller during movement along a flat surface and said rollers slip downwardly relative to said axle to maintain contact with surface depressions.

3. A roller-type dust seal for use with a sweeper having a generally horizontally positioned, open ended dust bin, said seal comprising:

an axle having an elongated base positioned adjacent the inlet of the dust bin;

means for attaching said axle to said dust bin and for permitting movement of said elongated base in a generally vertical direction; and a plurality of roller segments concentric with said elongated base, said roller segments each having a generally hollow, cylindrical shape and an inner diameter greater than the diameter of said elongated base, said rollers further having a relatively hard inner peripheral surface and a relatively soft outer peripheral surface whereby said roller segments are free to move radially of said axle and said elongated base of said axle is free floating and may also move in a vertical direction, said axle being generally U-shaped having legs extending generally perpendicular from the ends of said elongated base, said base and said legs being in substantially the same plane and the dust bin of the sweeper including an upwardly angled lip extending transversely along the inlet of the bin, and said attaching means comprising said lip having spaced apertures therein, each of said legs of said axle extending through one of said apertures; and blocking means secured to the terminal end of each of said legs for blocking return movement of said legs through said apertures.

4. A roller-type dust seal as defined by claim 3 wherein said apertures have a diameter greater than the diameter of said axle legs whereby said axle is free floating relative to said bin.

5. In combination, a dust bin having a top wall, a bottom wall, side walls, a front wall and an open inlet end, said dust bin being adaptable for generally horizontal mounting on a sweeper frame with the inlet spaced but adjacent to a rotating brush, and further including an improved dust seal, said dust seal comprising:

an elongated axle extending transversely of the bottom wall adjacent the inlet of the dust bin;

a plurality of abutting roller segments concentric with said axle, each of said roller segments having a generally hollow cylindrical shape, the inner diameter of said segments being substantially greater than the diameter of said axle so that said rollers are independently movable in a vertical plane, each of said roller segments further comprising an inner core and an outer core, said inner core being formed of a hard vinyl material and said outer core being formed of a softer vinyl material, said outer core comprising substantially one-half of the wall thickness of said roller segments and said bottom wall including an upwardly projecting transverse lip having apertures at opposite ends thereof and said elongated axle being generally U-shaped and including leg portions extending through said lip apertures whereby said roller segments are independently movable and said axle is movable in a generally vertical direction.

* * * * *